US009505574B2

(12) United States Patent
Kuchar et al.

(10) Patent No.: US 9,505,574 B2
(45) **Date of Patent: *Nov. 29, 2016**

(54) TRACTION CONTROL SYSTEM FOR EXPANSION AND DEPLOYMENT OF COMPACT TIGHTLY WOUND PAPER WITH DIE CUT SLITS

(71) Applicant: KUCHARCO CORPORATION, Metuchen, NJ (US)

(72) Inventors: David M. Kuchar, Metuchen, NJ (US); Matthew J. Kuchar, Metuchen, NJ (US)

(73) Assignee: KUCHARCO CORPORATION, Metuchen, NJ (US)

( * ) Notice: Subject to any disclaimer, the term of this patent is extended or adjusted under 35 U.S.C. 154(b) by 275 days.

This patent is subject to a terminal disclaimer.

(21) Appl. No.: 13/998,481

(22) Filed: Nov. 4, 2013

(65) Prior Publication Data

US 2015/0122935 A1 May 7, 2015

(51) Int. Cl.
*B65H 75/18* (2006.01)
*B65H 23/025* (2006.01)
*B65H 16/00* (2006.01)

(52) U.S. Cl.
CPC ..... *B65H 23/025* (2013.01); *B65H 16/005* (2013.01)

(58) Field of Classification Search
CPC ..... B65H 23/022; B65H 16/005; B65H 2301/41369; B31D 5/0056; B31D 5/0065; B31D 2205/0023
USPC ..... 242/597, 597.7, 597.8, 580, 580.1, 579, 242/585, 390, 390.2, 390.3, 390.4
See application file for complete search history.

(56) References Cited

U.S. PATENT DOCUMENTS

| | | | | |
|---|---|---|---|---|
| 1,548,789 A | | 8/1925 | Lorenz | 162/282 |
| 1,550,084 A | | 8/1925 | Lorenz | 162/282 |
| 4,859,169 A | | 8/1989 | Walton et al. | 425/336 |
| 4,921,118 A | | 5/1990 | Gass | 220/88.1 |
| 5,040,461 A | | 8/1991 | Van-Ocker | 101/288 |
| 5,667,871 A | | 9/1997 | Goodrich et al. | 428/136 |
| 5,755,656 A | * | 5/1998 | Beierlorzer | B31D 5/0047 493/464 |
| 6,019,715 A | * | 2/2000 | Ratzel | B31D 5/0047 493/464 |
| 6,468,197 B1 | * | 10/2002 | Lencoski | B31D 5/0047 493/357 |
| 6,910,997 B1 | * | 6/2005 | Yampolsky | B26F 1/22 493/350 |
| 6,989,075 B1 | | 1/2006 | Kao et al. | 162/125 |
| 8,486,507 B2 | | 7/2013 | De Luca et al. | 428/136 |
| 8,613,993 B2 | * | 12/2013 | Kuchar | D04D 9/00 229/87.01 |
| 8,919,689 B2 | * | 12/2014 | Kuchar | B65H 23/022 242/580.1 |
| 8,926,305 B2 | * | 1/2015 | Kuchar | B31D 3/002 242/580.1 |
| 2003/0073558 A1 | * | 4/2003 | Chesterson | B31D 5/0052 493/250 |
| 2009/0258775 A1 | * | 10/2009 | Chan | B31D 5/0047 493/464 |

* cited by examiner

*Primary Examiner* — William A Rivera
(74) *Attorney, Agent, or Firm* — Ernest D. Buff, Esq.; Ernest D. Buff & Associcates, LLC; Dave Narasimhan

(57) ABSTRACT

A traction control system expands and deploys compact tightly wound precut paper with die cut slits. The system has an axle with a smaller diameter as compared to the diameter of tube over which a precut paper package is wound, thereby providing friction free rotation. The precut paper roll rests against a spongy device at one end. The other end of the precut paper role rubs against an adjustable cylinder assembly, providing friction that prevents paper spill and misalignment. The precut paper is manually fed to a paper-handling-mechanism having a large diameter central bulge roll contacting a spring-loaded small diameter roll. A flat belt strung between two pulleys contacts the large diameter roll at the bottom to thereby support the paper. Precut paper exiting the paper-handling-mechanism is manually pulled by user in any direction to expand the precut slits and thereby create a three-dimensionally shaped paper web for packaging. Hard pulling breaks the paper without need for rethreading the paper-handling mechanism.

19 Claims, 5 Drawing Sheets

TRACTION CONTROL SYSTEM FOR EXPANSION AND DEPLOYMENT OF COMPACT TIGHTLY WOUND PAPER WITH DIE CUT SLITS

This is a Continuation-In-Part of application Ser. No. 13/112,106, filed on May 20, 2011 for "Apparatus To Deploy And Expand Web Material", the disclosure of which is hereby incorporated in its entirety by reference thereto.

BACKGROUND OF THE INVENTION

1. Field of the Invention

The present invention relates to manufacture of package filler material; and, more particularly, to a traction control system for expanding and deploying compact tightly wound paper with die cut slits suited for expansion and deployment of packaging material that cushions articles in a shipping package.

2. Description of the Prior Art

Numerous prior art patents and disclosures relate to delivering paper from cylindrical packages and cutting the papers into sheets of specific sizes. These paper rolls may be cut with slits and the paper product is expanded to a form suited for use as a packaging material. Paper is not delivered from the cylindrical paper package and is immediately used in small selected sizes to wrap packages.

U.S. Pat. No. 1,548,789 to Lorenz discloses a paper crinkling machine. The paper is crinkled during passage through a narrow throat formed by a sharpened blade or spring loaded roll. The constriction at the throat crinkles the paper due to the blockage at the throat and the delivery belt 23 delivers the crinkled paper. The paper used is not cut with slits. Since the machine is power driven, the delivery of the crinkled paper is continuous and is not limited to the length requirements for a specific packaging operation.

U.S. Pat. No. 1,550,084 to Lorenz discloses paper crinkling machine. The paper is crinkled during passage through a pair of rolls having matching ribs and grooves. The paper used is not cut with slits. Since the machine is power driven, the delivery of the crinkled paper is continuous and is not limited in accordance with the length needs for a particular packaging operation.

U.S. Pat. No. 4,859,169 to Walton, et al. discloses web processing by longitudinal compression using a matched drive disk and retarding fingers. The paper is crinkled during passing through a pair of rolls having matching ribs and grooves. The paper used is not cut with slits. Since the machine is power driven, the delivery of the crinkled paper is continuous and is not restricted in accordance with the length needs for a specific packaging operation.

U.S. Pat. No. 4,921,118 to Gass discloses manufacture of filling material for hollow spaces. A foil strip is at first continuously provided with intermittent longitudinal cuts and subsequently stretched in a vertical direction. A cutting device consists of two reciprocal rollers with cutting edges that are intermittently arranged in the circumferential direction. The cutting device produces longitudinal cuts, while a stretching unit vertically stretches the cut strips of foil. A drive is provided, together with a feed and removal unit. The strip used is a metallic strip, not a paper strip.

U.S. Pat. No. 5,040,461 to Van-Ocker discloses a label printing and dispensing apparatus. A label printer and dispenser web transport system includes a motor driven platen and a print head resiliently directed against the platen between which an ink foil and label web are passed. The web travels over a triangular peeler bar disposed closely adjacent the platen and is then returned to the platen for passage between the platen and a spring biased idler roll, deformably engaging the platen to maintain web tension over the peeler bar. The print head is pivotally mounted and is moved out of engagement with the platen when the print head is not printing. The ink foil is not advanced when the print head is moved away from the platen. The labels are precut objects and the sheet carrying the labels is driven by rollers and passed over a sharp edge to peel the labels. The sheet has no cut slits and is not expanded.

U.S. Pat. No. 5,667,871 to Goodrich, et al. discloses slit sheet packing material. A filling material for use in filling hollow spaces in packaging or the like comprises one or more pieces of flexible paper material. The paper material has a plurality of individual slits formed in parallel spaced rows extending transversely from one end of the paper material to the opposing end of the paper material. The slits in adjacent alternate rows are positioned adjacent the interval space between adjacent slits in the adjacent parallel row of slits. The flexible paper material is expanded by extending the opposing ends of the paper material, which are parallel to the rows of slits whereby the slits form an array of openings, each opening being generally hexagonal in shape and of the same size. The length and width of the flexible filling paper material can be varied. The construction of the flexible paper filling material permits it to be easily stored in the non-expandable position and easily expanded for use in filling hollow spaces in packaging. As shown in FIG. 2, precut sheets are stacked and expanded prior to use in a packaging application. The sheets are not delivered from a continuous roll. Pulling of a sheet forms the expanded configuration, tearing the sheet according to desired lengths of the user.

U.S. Pat. No. 6,989,075 to Kao, et al. et al. discloses a tension activatable substrate that is a dual intensive property tissue. The tissue has a first set of intensive properties including density, surface area, thickness and void volume as presented to the consumer. The consumer plastically activates the tissue by pulling it in tension. A series of slits 44 or other lines of weakness elongate in a direction parallel to the line of tension, allowing the tissue to achieve a second state of intensive properties. The value of the second state of intensive properties is different after activation. The change in value of the intensive properties allows for economies in shipping, where a higher density product is shipped to the consumer. At the point of use, the consumer activates the product to achieve the increase surface area and lower density. The increase in surface area and concomitant decrease in density provides for increased efficacy in cleaning. The plastically activatable state may be provided by a series of slits 44 or other lines of weakness in the tissue. The tissue may comprise cellulosic and/or synthetic fibers. The tissue may be used as a facial tissue, bath tissue, paper towel, napkin, body wipe, mophead, etc. Activation is triggered by applying tension to the flat sheet, which is presented in the first state. The activated expanded second sheet is not presented to the customer in a condition that is ready for packaging.

U.S. Pat. No. 8,486,507 to De Luca et al. discloses an expandable foam sheet that locks in the expanded configuration. This mechanically expandable foam sheet comprises a plurality of discrete slits therein that allow the foam sheet to be expanded from an unexpanded foam sheet configuration to an expanded foam sheet configuration. The expandable foam sheet has a density of from 14 g/liter to 48 g/liter in the unexpanded configuration and a thickness of from 6 mm to 50 mm. The slits are of a kind and of a size and arrangement that the expanded foam sheet locks into the expanded configuration by exhibiting a pressure-to-close of at least 5 gm/cm$^2$. Each of the slits provides only a single free volume in the expanded foam sheet. An expandable foam sheet having serpentine-shaped expansion and locking arms is also indicated, as are various cushioning articles comprising an expanded foam sheet. This foam sheet is not a paper product with slits that is expandable.

Based on the foregoing, there exists a need in the art for a compact machine that readily accepts a roll of paper with pre cut slit shapes adapted to expand and create a three dimensional packaging product. It would be particularly desirable if the machine was equipped with means for gently delivering the paper with slits without undue stretching of the paper. It would also be desirable if the paper was designed to expand to the three dimensional shape when the user pulled out the paper from the machine. Such a machine would be highly advantageous in that tearing the expanded paper product at desired lengths would efficiently and reliably produce a filler material that facilitated packaging of delicate articles during shipping.

SUMMARY OF THE INVENTION

The present invention provides a compact machine that readily accepts a roll of paper with pre cut slit shapes adapted to expand and create a three dimensional packaging product. The machine is equipped with means for gently delivering the paper with slits without undue stretching of the paper. Upon being pulled from the machine, the paper expands to the three dimensional shape. Expansion of paper is effected regardless of the direction in which the sheet is pulled. Tearing the expanded paper product at desired lengths efficiently and reliably produces a filler material that facilitates packaging of delicate articles during shipping.

A precut paper roll in the form of a compact package is placed on a machine, which is manually operated. The paper from the precut paper roll is delivered through a paper handling mechanism that includes rolls and a support belt. Delivery is effected when the user pulls the paper. This pulling action, which may be in any direction, expands the precut paper to create a three dimensional spongy packaging material which has portions of the paper extending above and below nominal paper surface.

The precut paper roll is very sensitive to any deformation due to the plurality of cuts therein, and generally results in unpredictable stretches and shapes of the paper when handled in machinery, thereby creating a mess. It is therefore essential that the precut paper be delivered with minimal stretches. This, in turn, requires that the paper roll be essentially floating. It also requires that the precut paper handling structures pull the paper in a uniform manner with no off angle feed of the paper. The precut paper roll is generally wound on a paper or polymeric tube similar to a toilet paper roll, and is inserted into an axle provided on the machine. The axle has a diameter smaller than that of the tube aperture, so that the precut paper roll is free to rotate with minimal friction. However, the precut paper may be drawn at off angles, and proper drawing of the precut paper requires that the free precut paper roll be prevented from tilting. In addition, reduced friction between the tube inner surface and the axle outer surface will cause the precut paper to spill, which is highly undesirable. The design features of the precut paper delivery machine prevent each of these problems. The first feature includes a springy device against which the precut paper roll rests. The springy device comprises two sheets of high molecular weight polyethylene with a polyurethane foam therebetween. This spongy spring action prevents any angular misalignment of the precut paper roll and restores proper alignment of precut paper due to higher spring action where the polyurethane foam is excessively compressed. The other end of the precut paper roll distant from the spongy device rests against a friction-generating cylinder pegged in a hole in the axle and is capable of rotation in a plane parallel to the axes. The location of the friction generating cylinder is adjustable by the user using a screw, which may be turned to bear the outer surface of the polymeric cylinder against the edge of the precut paper roll. The friction generating assembly, in one embodiment, comprises a fixed cylinder and a movable cylinder that is attached to the fixed cylinder by a screw and guides, and the assembly is pegged through a hole provided in the axle. The movable cylinder may be advanced by a screw to create a higher level of rub between the movable cylinder and the outer surface of the precut paper roll, creating higher level of friction. The movable cylinder may be replaced with a rectangular or square cross-section. If the screw is turned backwards, the movable cylinder is withdrawn assisted by an O-ring retainer; this reduces the level of friction applied to the precut paper roll. This adjustment prevents the spillage of paper as the precut paper is drawn from the precut paper roll. This arrangement in combination with the spongy device essentially floats the precut paper roll, preventing paper spill. Application of excessive stresses to the precut paper is additionally avoided, preventing expansion within the machine.

The paper is first manually withdrawn from the precut paper roll and inserted into a paper handling mechanism. The paper handling mechanism includes a large roll, about 5 to 12 inches in diameter. The outer surface of the roll is made convex by provision of a central bulge. A smaller diameter support roll having a diameter of 2 to 6 inches is pressed against the roll by spring action forming a nip through which the precut paper may be manually inserted. Two pulleys are provided below the larger roll and a flat belt passes over the pulleys' outer diameters. The belt firmly contacts the bottom surface of the large diameter roll providing a contact region in the range of 20 to 70 degrees. The belt is aligned with the bulged portion of the large diameter roll. The precut paper is typically inserted through the contact region of the paper handling mechanism, through the small diameter support roll and nip first, and then between the large convex bulge roll belt and pulleys. The precut paper, being fully threaded therethrough when pulled is now kept and controlled as it exits the paper handling mechanism. Thus when the precut paper is pulled by the user at the exit of the paper handling mechanism the flow of precut paper through the entire machine is uniform with no undue stretches since the belt, large diameter roll, spring assisted small diameter roll run together and precut paper is uniformly withdrawn from the floating precut paper roll with no angular misorientation, spill and other feeding problems. The paper handling mechanism automatically aligns the precut paper flow due to use of large diameter roll with a central bulge, the spring loaded supporting smaller diameter roll, and the centrally aligned belt. The paper may be pulled at any angle by the user to expand the precut features and thereby form a three dimensional springy packaging material. The user selects the required length of packaging material and pulls hard to tear the paper. The paper handling mechanism grips the paper while the paper is torn, and the precut paper does not have to be rethreaded through the paper handling mechanism.

Significant advantages are realized by practice of the present invention. In its preferred embodiment, the system for traction control for expansion and deployment of compact tightly wound paper package of paper with die cut slits of the present invention comprises:

i) a compact tightly wound precut paper being axially wound to form a tubular interior or wound on a tube to form a tubular interior;

ii) said tube tubular interior having a larger diameter aperture as compared to the axle diameter of the traction control associated with the expansion machine over which the tightly wound precut roll package is inserted. This arrangement facilitates floating the package with minimal friction or misalignment from side to side;

iii) said precut paper roll resting against a spongy device on the axle, preventing angular misorientation of the precut paper roll;

iv) said spongy device comprising a pair of polymeric sheets with a sponge inserted therebetween;

v) the distal end of precut roll rubbing against an adjustable cylinder assembly, thereby generating friction that prevents spill of precut paper while maintaining central alignment and uniform precut paper feed due to pressure of the precut paper roll against the spongy device;

vi) the precut paper is manually inserted into a paper handling mechanism that comprises a large diameter roll with a bulgy central portion, a spring loaded small diameter support roll and a flat belt contacting the bottom portion of the large diameter roll; and vii) the user pulling paper through the contact portion of the large diameter roll, the spring loaded small diameter support roll and belt supporting the precut paper, and applying a pulling force to the precut paper, thereby uniformly drawing precut paper from said precut paper roll;

whereby the precut paper roll floats and the paper handling mechanism aligns the paper centrally, preventing undue expansion of precut paper while gripping the paper when pulled by the user in any direction, to create a three dimensional web expansion especially suited for packaging paper, and gripping action during a hard tearing pull on said expanded web of paper packaging material secures the unexpanded precut paper, eliminating the need for rethreading the paper handling mechanism.

In another aspect of the invention, a more advanced drag or braking for the web can be accomplished by attaching the spongy device's rear plate to a motorized linear actuator's rod. The attachment is effected by a perpendicular connection located centrally to the centered most point of the spongy device's rear plate. This arrangement facilitates movement of the spongy device in a linear direction in the amount of 0" to ½". The actuator is used for compressing or decompressing the spongy device. The spongy device, as connected to the actuator, is controlled incrementally by using sensor signals to a computing device or logic control. Typically, control of the actuator is enabled using a web tension sensor of the transducer type, or the like measuring slack in the web. A proximity sensor (ultrasonic type) or the like typically measures the diameter of a roll such as a pre-slit paper package. Sensors can be used independently or more than one at a time to control the actuator. Therefore signals from one or more sensors are used to control the actuator' rod, which is connected to said spongy device to accommodate compression or decompression of the spongy device. The actuator rod is moved to and fro, incrementally using signal inputs from sensors to a Programmable Logic Control (PLC) or Programmed Logic Chip, or the like, or a computer. These programmable computing devices can be used with or without a feedback loop and typically have a reset feature, or can be programmed to accomplish the correct web tension and control. In this manner, the spongy device is decompressed as the roll is continuously off-wound, thereby controlling drag or braking of the web. The linear actuator is mounted to the vertical column behind the spongy device with its rod passing through the vertical column and is attached to the back of the spongy device.

BRIEF DESCRIPTION OF THE DRAWING

The invention will be more fully understood and further advantages will become apparent when reference is had to the following detailed description of the preferred embodiments of the invention and the accompanying drawing, in which.

DETAILED DESCRIPTION OF THE INVENTION

Figure 1:
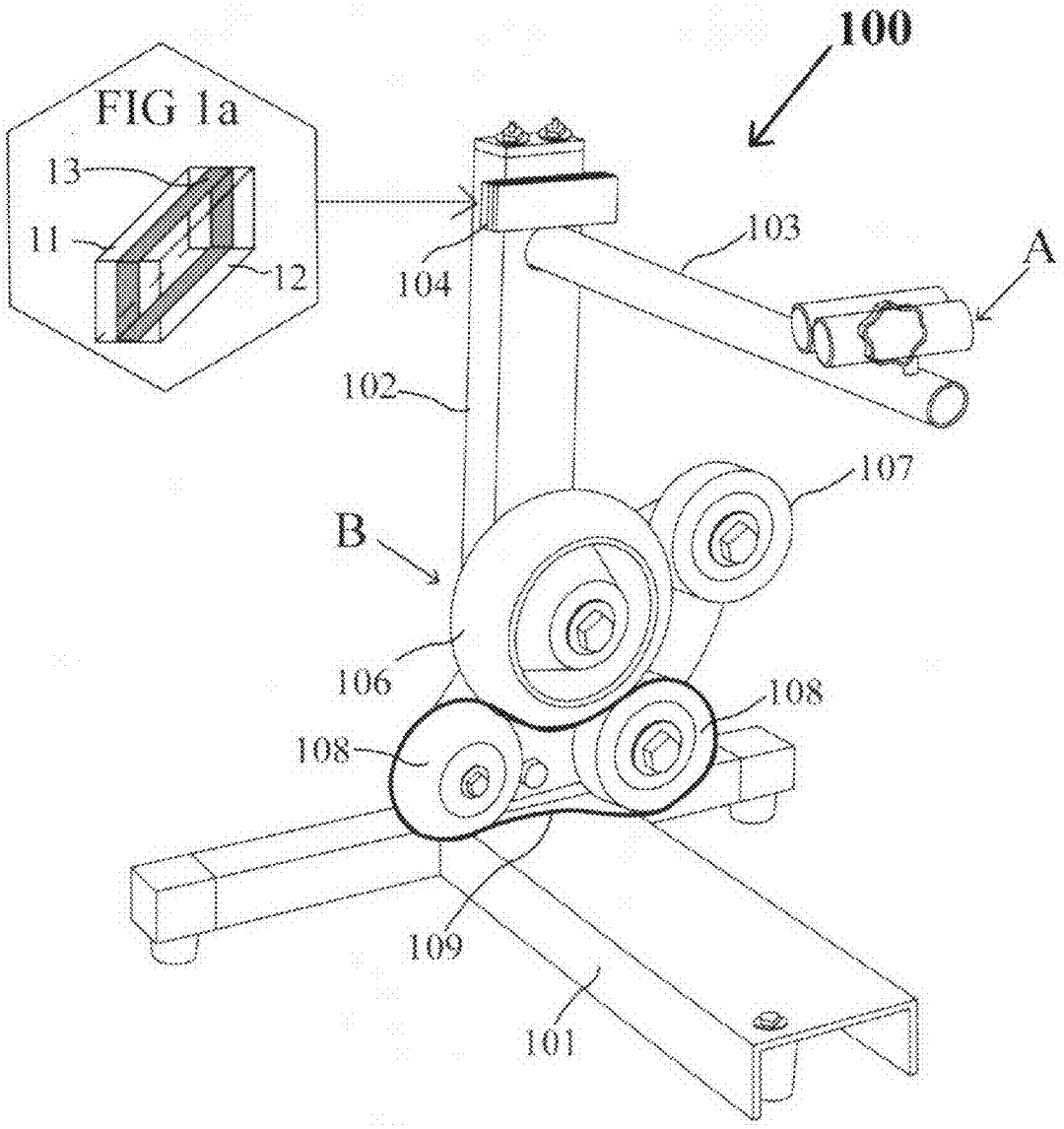
FIG. 1 is a schematic arrangement of the traction control system for expansion and deployment of a compact tightly wound package of paper with die cut slits.

This invention relates to a traction control system for expansion and deployment of a compact tightly wound package of paper with die cut slits. A paper roll has die cut slits suited for expansion. Preferably, the die cut slits are in the form of tilde shapes that are offset from each other as detailed in the published US patent application 2010/0196633. The paper with these precut slits expands very easily and any application of stresses to the paper in any direction causes severe deformation of the paper. Any machine that delivers the precut paper to a user must drive the paper with minimal stresses applied; and this is a difficult task.

The present invention deals with several aspects of stress generation when driving the precut paper from a compact tightly wound roll. The compact precut paper roll is wound on a central tube and is slipped on an axle of the machine of the present invention. Since the diameter of the axle is smaller than that of the tube of the precut paper roll, the latter rolls with minimal friction, but is subject to angular misalignment. The axle has a spongy device against which the compact precut paper roll rests. The spongy device is made from two polymeric sheets separated by a sponge. The polymeric sheets may be ultra high molecular weight polyethylene or any other suitable plastic material or metallic material. The sponge may be a polyurethane foam or other springy material such as a helical spring. This spongy device prevents angular misalignment of the compact precut roll since the spongy device pushes against the misoriented direction bringing the compact precut paper roll into proper alignment. The other end of the compact precut paper roll rests against a position adjustable cylinder assembly pegged to an aperture in the axle so that the assembly is free to rotate. The cylinder is adjusted to rub against the periphery of the compact paper roll or an end cap associated with the tubular interior of the roll. With this arrangement, there is generated sufficient friction to prevent spillage of precut paper from the floating compact paper roll. In addition, the compact paper roll is pressed against the spongy device at all times by the force applied by the rubbing cylinder; this maintains uniform flow of precut paper through the machine of the present invention.

The precut paper is manually pulled from the compact precut paper roll and fed into the paper handling machinery. The paper handling machinery includes a large roll having a diameter in the range of 5 to 12 inches with a bulgy central outer diameter, contacting a spring loaded smaller diameter roll having a diameter in the range of 2 to 6 inches. The bulgy central portion of the large diameter roll periphery directs the paper without angular misorientation. The large diameter roll contacts the tension side of a flat belt strung between two pulleys with the angular wrap of the belt ranging from 20 to 70 degrees. When the precut paper is inserted through the nip between the larger diameter roll and the small diameter spring loaded support roll, it also passes between the large diameter roll and the flat belt and exits the machine. Pulling on the paper in any direction expands the slits, creating three dimensional springy shapes suited for a packaging machine.

FIG. 1 is a schematic arrangement of the traction control system for expansion and deployment of compact tightly wound paper package of paper with die cut slits. The system, shown generally at 100, has an axle 103 designed to receive a compact precut paper roll package, which is in the unexpanded state. The compact precut paper roll is designed to rest and push against the spongy device 104, shown in detail in FIG. 1*a*. The sponge device comprises hard plastic sheets 11 and 12 with a sponge 13 interposed therebetween. The plastic sheets may be made from ultra high molecular weight polyethylene or other plastics and the sponge is a polyurethane sponge or other springs. This sponge device prevents misalignment of the compact precut paper roll. The other end of the paper roll rubs against the friction generating cylinder as shown in detail by FIG. 3. The paper handling mechanism B comprises a large diameter roll 106 which has a bulge in the middle of its outer surface, a small diameter spring loaded support roll 107 and a flat belt 109 strung between two pulleys 108, contacting the bottom surface of the large diameter roll 106. The vertical column of the machine is shown at 102 and the horizontal base of the machine is shown at 101.

Figure 2:
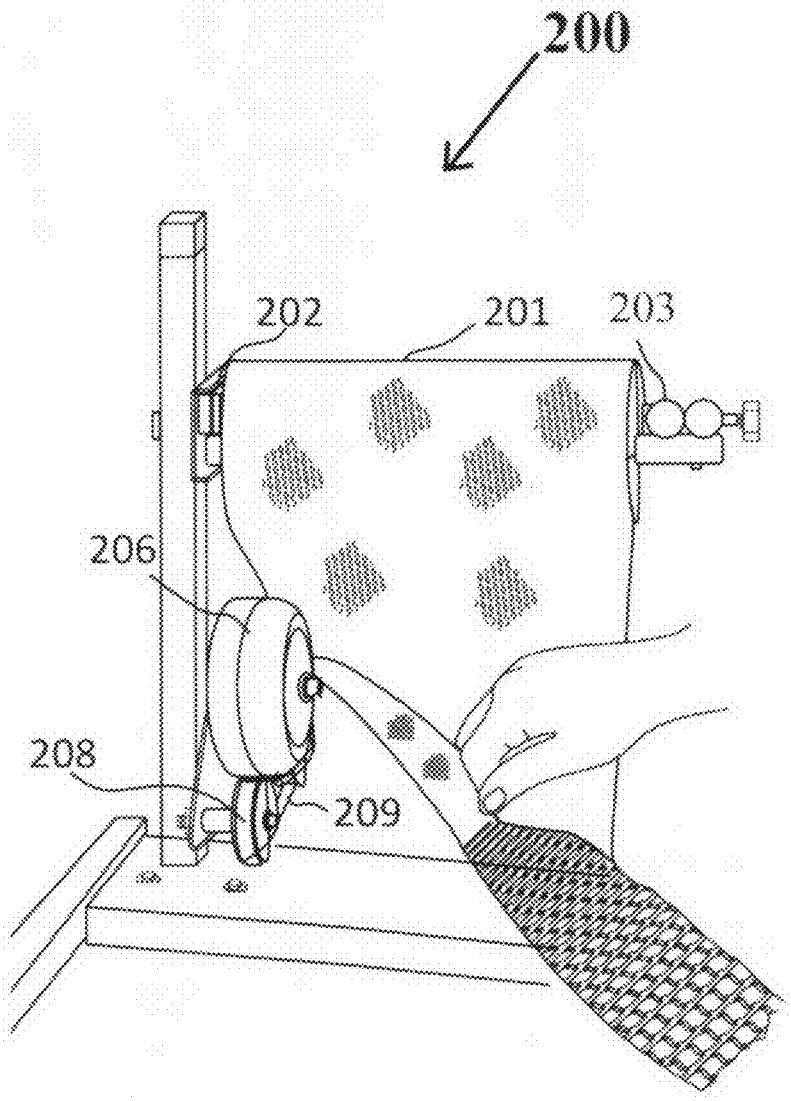
FIG. 2 is a schematic illustration of the system for traction control depicting the expansion and deployment a compact tightly wound paper package of paper with die cut slits.

FIG. 2 shows at 200 a schematic illustration of the traction control system for expansion and deployment of a compact tightly wound package of paper with die cut slits. This drawing has all the elements marked in FIG. 1. Shown therein is compact roll 201 of precut paper in the unexpanded state. Spongy device 202 prevents misalignment of the roll. Adjustable cylinder 203 rubs against the outer surface of the end cap inserted into the compact role, generating friction and helping to control axial misalignment and paper run out. This friction prevents spillage of the compact precut paper roll, while the horizontal force applied by the cylinder pushes the compact precut paper roll against the spongy device, preventing misalignment. The paper is fed between the large diameter roll 206 and the spring loaded small diameter roll 107 of FIG. 1. Pulleys 208 carry the flat belt 209, which contacts the large diameter roll. The paper is securely held by the paper handling mechanism while the user's hand, pulling on the paper in any direction, expands the paper into three dimensional shape suited for packaging. If the paper is pulled with a greater force, it tears; but the paper is still held by the paper handling mechanism. With this arrangement, the need to rethread the paper within the paper handling mechanism is substantially prevented.

Figures 3, 3A, 3B:
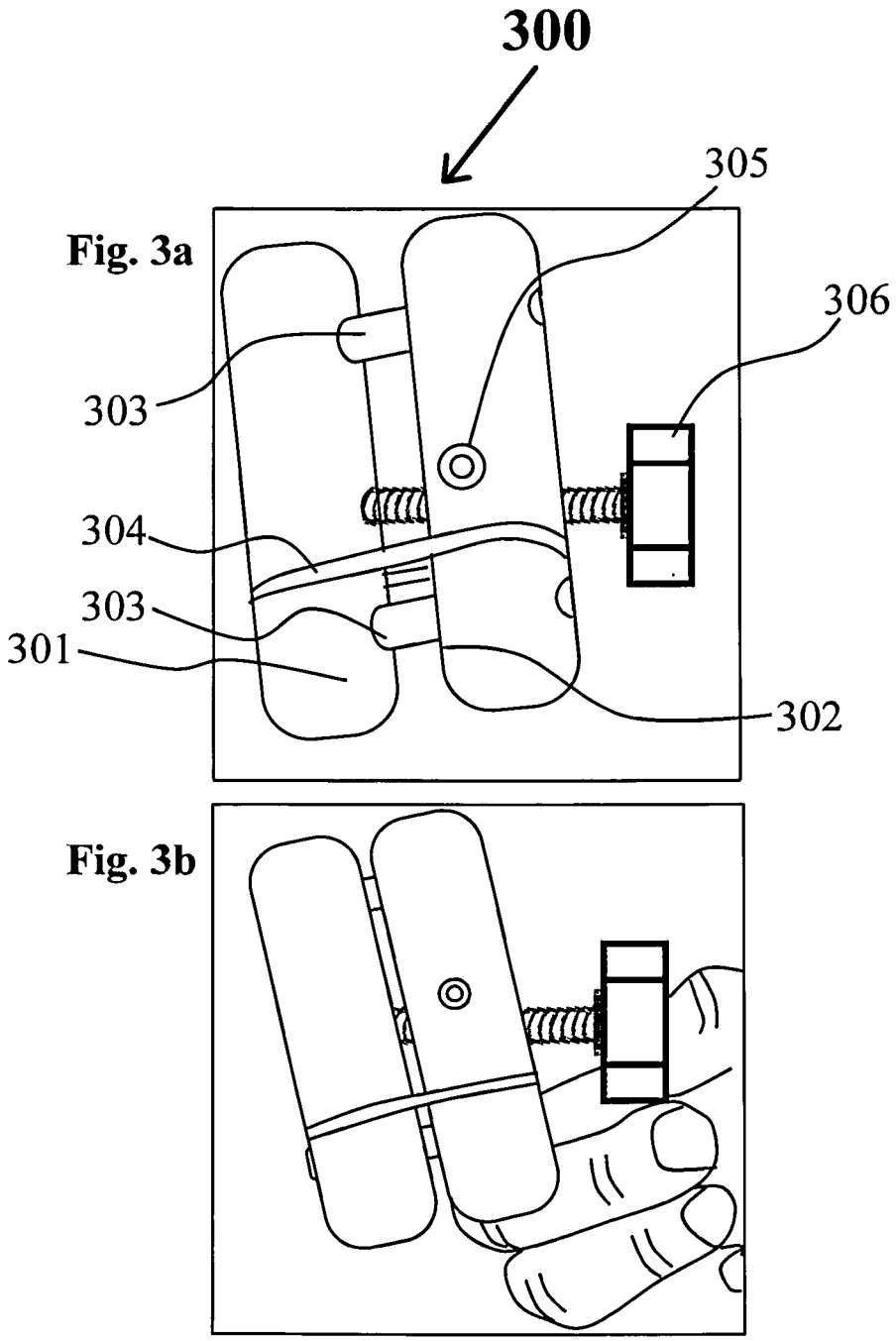
FIG. 3*a* is a perspective view of a friction generating device, showing a pair of polymetric cylinders in a first position.
FIG. 3*b* is a perspective view of a friction generating device, showing a pair of polymetric cylinders in a second position.

FIGS. 3*a* and 3*b* of FIG. 3 illustrate the friction generating cylinder 300 in a first position and a second position, respectively. Polymeric cylinder 301 contacts the side periphery of the compact precut paper roll, generating friction or drag. The position of 301 is adjusted by turning screw 306 which displaces the movable cylinder 301 with respect to fixed cylinder 302, causing cylinder 301 to move from a first position to a second position. The latter is pegged to the axle by pin 305 through an aperture in the axle. The O-ring 304 retracts cylinder 301 towards cylinder 302 when the screw is loosened, causing movement of cylinder 301 between the first and second positions. The two cylinders always remain substantially parallel due to the guides 303.

Figure 4:
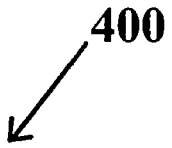
FIG. 4*a* is a side view illustrating the details of the paper handling mechanism, showing in particular the belt, pulleys, large roll and small diameter support roll.
FIG. 4*b* is a back view illustrating details of the paper handling mechanism, showing in particular the small diameter roll and nip, and spring, and a portion of the large diameter roll and web, prior to expansion.
Figure 4A:
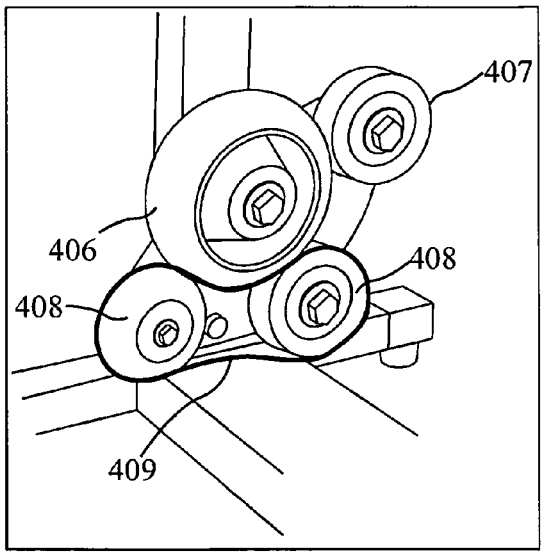
Figure 4B:
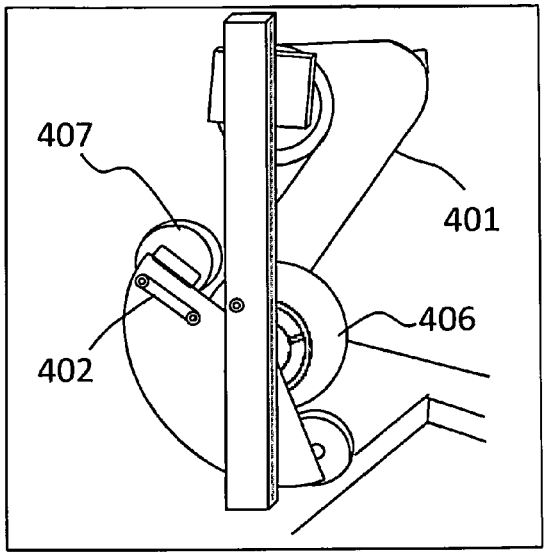

FIG. 4 illustrates at 400 the details of the paper handling mechanism in two views, FIG. 4*a* and FIG. 4*b*. The larger roll is shown at 406. The spring loaded small diameter support roll is shown at 407. Pulleys 408 carry the flat belt 409, which contacts and wraps abound the bottom portion of large diameter roll holding web 401 in place between spring loaded small support roll 407 and larger roll 406. The spring is shown at 402 in FIG. 4*b*. Spring 402 pulls the small diameter support roll against the large diameter roll.

Figure 5:
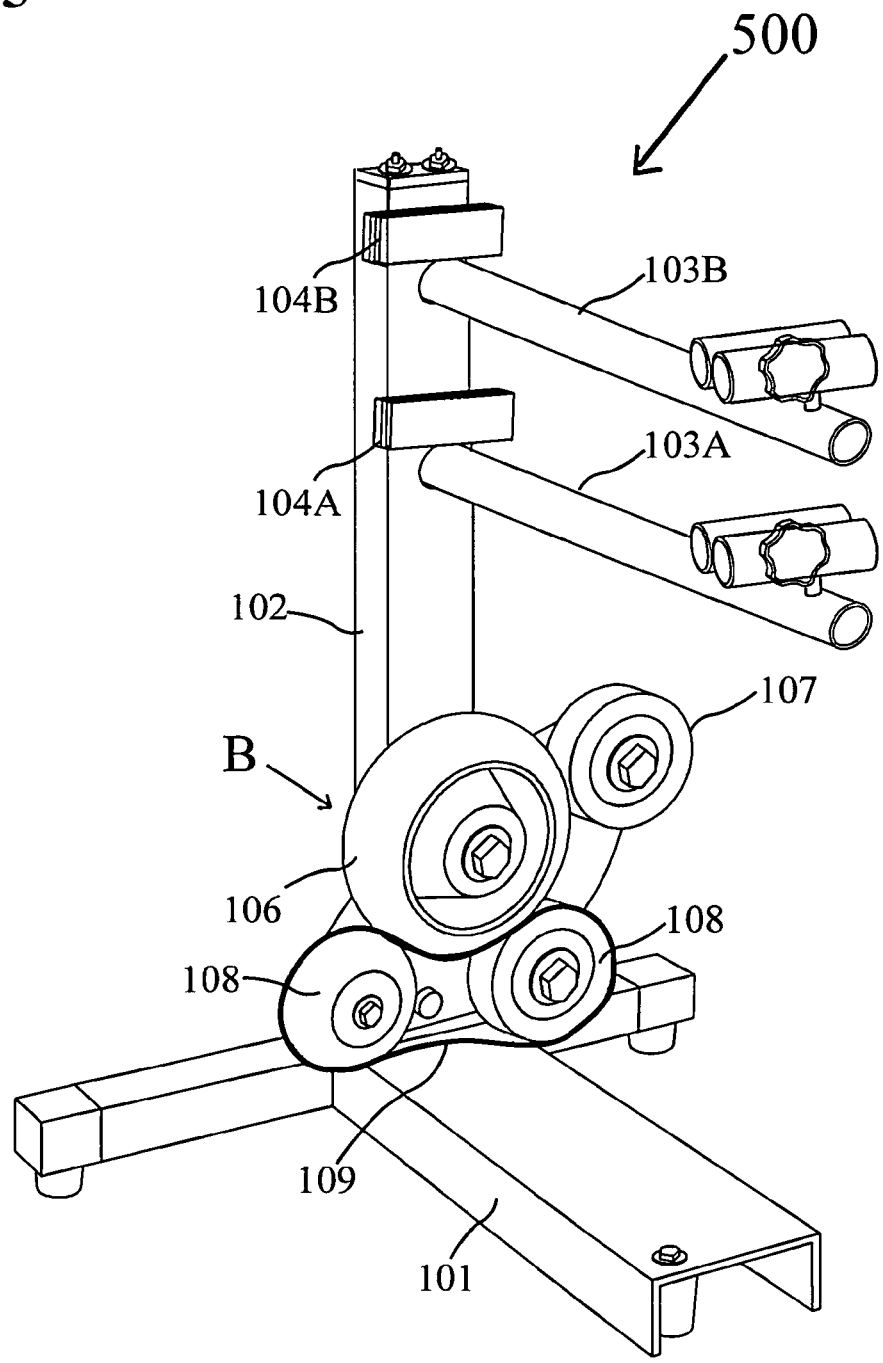
FIG. 5 is a schematic arrangement of the traction control system for expansion and deployment of two compact tightly wound package of paper with multitudinous die cut slits mounted on two axles.

FIG. 5 is a schematic arrangement of the traction control system for expansion and deployment of two compact tightly wound package of paper with die cut slit mounted on two axles. This figure is identical to FIG. 1 except it has two axles for receiving two rolls of precut paper. The two axles are shown at 103A and 103B. Corresponding sponge devices are shown at 104A and 104B.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A traction control system for expansion and deployment of compact tightly wound precut paper with die cut slits, comprising:

a) compact tightly wound precut paper disposed on a tube having a tubular interior or being axially wound to form a tubular interior;

b) said tubular interior having a larger diameter aperture as compared to the axle diameter of the traction control over which the tightly wound precut roll package is inserted to float the package with minimal friction or misalignment from side to side;

c) said precut paper roll resting against a spongy device on the axle preventing angular misorientation of the precut paper roll;

d) the distal end of the precut paper roll rubbing against an adjustable cylinder assembly to generate friction that prevents spill of precut paper while maintaining central alignment of paper delivery and uniform precut paper feed due to pressure of precut paper roll against said spongy device; and e) the precut paper from the compact precut roll being manually inserted into a paper handling mechanism that comprises a large diameter roll with a bulgy central portion, a spring loaded small diameter support roll and a flat belt strung between a plurality of pulleys and contacting the bottom portion of the large diameter roll;

whereby a user is capable of pulling paper through the contact portion of the large diameter roll, the spring loaded small diameter support roll and the belt, thereby uniformly drawing precut paper from said precut paper roll; and whereby the precut paper roll floats and the paper handling mechanism aligns the paper centrally, preventing undue expansion of precut paper while gripping the paper when pulled by the user in any direction to create a three dimensionally expanded paper web suited for packaging, and gripping action exerted on said paper web while tearing said expanded paper secures the unexpanded precut paper, substantially eliminating the need for rethreading said paper handling mechanism.

2. The traction control system for expansion and deployment of a compact tightly wound precut paper package with die cut slits as recited by claim 1, wherein the said spongy device comprises a pair of polymeric sheets with a sponge inserted therebetween.

3. The traction control system for expansion and deployment of a compact tightly wound precut paper package with die cut slits as recited by claim 2, wherein said polymeric sheet is high molecular weight polyethylene.

4. The traction control system for expansion and deployment of a compact tightly wound precut paper package with die cut slits as recited by claim 2, wherein said sponge is polyurethane sponge.

5. The traction control system for expansion and deployment of a compact tightly wound precut paper package with die cut slits as recited by claim 1, wherein said slits are tilde shaped.

6. The traction control system for expansion and deployment of a compact tightly wound precut paper package with die cut slits as recited by claim 1, wherein said adjustable cylinder generating friction comprises a fixed cylinder pegged to a hole in the axle connected to a movable cylinder through a screwed connection.

7. The traction control system for expansion and deployment of a compact tightly wound precut paper package with die cut slits as recited by claim 6, wherein said movable cylinder and fixed cylinder are connected by tracks maintaining a substantially parallel disposition.

8. The traction control system for expansion and deployment of a compact tightly wound precut paper package with die cut slits as recited by claim 7, wherein said movable cylinder has a rectangular cross section.

9. The traction control system for expansion and deployment of a compact tightly wound precut paper package with die cut slits as recited by claim 8, wherein said movable cylinder has a square cross section.

10. The traction control system for expansion and deployment of a compact tightly wound precut paper package with die cut slits as recited by claim 7, wherein said movable cylinder has a circular cross section.

11. The traction control system for expansion and deployment of a compact tightly wound precut paper package with die cut slits as recited by claim 1, wherein said large diameter roll has a diameter in the range of 5 to 12 inches.

12. The traction control system for expansion and deployment of a compact tightly wound precut paper package with die cut slits as recited by claim 1, wherein said spring loaded small diameter support roll has a diameter in the range of 2 to 6 inches.

13. The traction control system for expansion and deployment of a compact tightly wound precut paper package with die cut slits as recited by claim 1, wherein the flat belt contacts the bulgy central portion of the large diameter roll in the angular range of 20 to 70 degrees.

14. The traction control system for expansion and deployment of a compact tightly wound precut paper package with die cut slits as recited by claim 1, wherein said an adjustable cylinder assembly rubs against an end cap inserted in the tubular interior.

15. The traction control system for expansion and deployment of a compact tightly wound precut paper package with die cut slits as recited by claim 1, said tubular interior being associated with at least one end cap.

16. The traction control system for expansion and deployment of a compact tightly wound precut paper package with die cut slits as recited by claim 1, having at least one end cap so disposed with respect to said tubular interior that said end cap rubs against said adjustable cylinder assembly to generate said friction.

17. The traction control system for expansion and deployment of a compact tightly wound precut paper package with die cut slits as recited by claim 1, further comprising a motorized linear actuator for automatically adjusting sponge decompression to control friction or drag on said precut paper roll during delivery of said precut paper.

18. The traction control system for expansion and deployment of a compact tightly wound precut paper package with die cut slits as recited by claim 17, wherein said motorized linear actuator presets compression on said sponge, which pressure is controllably reduced in accordance with web tension and roll diameter to maintain proper pressure against said sponge as said roll diameter decreases.

19. The traction control system for expansion and deployment of a compact tightly wound precut paper package with die cut slits as recited by claim 17, wherein for any size roll placed on said axle of said traction control, said linear actuator automatically presets compression of said spongy device to thereby maintain constant a correct web tension until said paper package is finally spent.

* * * * *